US011377297B2

(12) United States Patent
Collay

(10) Patent No.: US 11,377,297 B2
(45) Date of Patent: Jul. 5, 2022

(54) DEFLECTOR FOR PROTECTING THE FEET OF A STRUCTURE

(71) Applicant: Philippe Collay, Villennes sur Seine (FR)

(72) Inventor: Philippe Collay, Villennes sur Seine (FR)

( * ) Notice: Subject to any disclaimer, the term of this patent is extended or adjusted under 35 U.S.C. 154(b) by 0 days.

(21) Appl. No.: 16/959,269

(22) PCT Filed: Dec. 28, 2018

(86) PCT No.: PCT/FR2018/053557

§ 371 (c)(1),
(2) Date: Oct. 26, 2020

(87) PCT Pub. No.: WO2019/135046

PCT Pub. Date: Jul. 11, 2019

(65) Prior Publication Data

US 2021/0053754 A1 Feb. 25, 2021

(30) Foreign Application Priority Data

Jan. 2, 2018 (FR) ..... 18 00004

(51) Int. Cl.
*E04B 1/66* (2006.01)
*B65D 90/14* (2006.01)
(Continued)

(52) U.S. Cl.
CPC ..... *B65D 90/14* (2013.01); *E04B 1/66* (2013.01); *E04H 7/06* (2013.01); *B65D 88/76* (2013.01); *E04B 1/72* (2013.01)

(58) Field of Classification Search
CPC ..... B65D 90/12; B65D 88/76; B65D 90/14; E04D 27/38; E04H 7/00; E04H 7/06; E04B 1/72; E04B 1/66
(Continued)

(56) References Cited

U.S. PATENT DOCUMENTS 5,303,523 A * 4/1994 Hand ..... A01G 13/105 119/61.53
5,678,362 A * 10/1997 Hulls ..... E04B 1/72 43/124
(Continued)

FOREIGN PATENT DOCUMENTS

CN 101734447 A 6/2010
CN 102031889 A 4/2011
(Continued)

OTHER PUBLICATIONS

International Search Report for corresponding application PCT/FR2018/053557 filed Dec. 28, 2018; dated Apr. 11, 2019.

*Primary Examiner* — Phi D A
(74) *Attorney, Agent, or Firm* — Cantor Colburn LLP

(57) ABSTRACT

The invention relates to a removable deflector for protecting the feet of a structure, which corrode following infiltration of water under the bottom plates and which weakens these areas. The invention concerns a removable device enabling the positioning of protection for the feet of storage tanks without a shut-down of production. The device according to the invention is a deflector element and a deflector assembly consisting of a plurality of deflector elements, capable of being positioned one after the other in order to surround the feet of the wall of the structure. Each deflector element comprises at least one downward-sloping protective plate (1), at least one flexible sealing gasket attached along the upper edge of this plate (1), and: at least one retaining arm (5) for same, wherein one of its ends is fixed to the so-called upper edge of said plate (1) and the other so-called distal end
(Continued)

E-E' CROSS-SECTION OF THE FIG. 4 is capable of being rigidly and reversibly attached to an element of said structure and to be detached therefrom, this arm allowing the adjustment of the pressing of the sealing gasket against the wall (14) of the tank, and at least one support (6) arranged towards its lower edge and separable into at least two parts suitable for making the deflector removable, of which the upper one is attached underneath the plate (1) and the other, lower one, is attached to the support slab (23) of the structure wall (14).

9 Claims, 6 Drawing Sheets

(51) Int. Cl.

| | |
|---|---|
| ***B65D 88/76*** | (2006.01) |
| ***E04H 7/06*** | (2006.01) |
| *E04B 1/72* | (2006.01) |

(58) Field of Classification Search
USPC ..... 52/169.5, 169.7, 169.14, 302.1, 302.3, 52/302.5, 716.2, 97
See application file for complete search history.

(56) References Cited

U.S. PATENT DOCUMENTS

| | | | | |
|---|---|---|---|---|
| 7,621,079 | B2 * | 11/2009 | Takagi | E04B 1/70 52/100 |
| 8,166,725 | B2 * | 5/2012 | Griffith | B63B 17/00 52/716.2 |
| 8,650,809 | B2 * | 2/2014 | Kaiser | E04D 13/00 52/84 |
| 2002/0108317 | A1 * | 8/2002 | DeGarie | B01D 17/0208 52/63 |
| 2011/0041426 | A1 * | 2/2011 | Trotter | E02D 31/02 52/169.5 |
| 2011/0099924 | A1 * | 5/2011 | Huang | E04D 13/174 52/198 |
| 2015/0075095 | A1 * | 3/2015 | Kelly | E04F 13/007 52/302.1 |

FOREIGN PATENT DOCUMENTS

| | | | |
|---|---|---|---|
| DE | 20007583 | U1 | 12/2000 |
| FR | 3002927 | A1 | 9/2014 |
| GB | 2351983 | A | 1/2001 |
| JP | 201324007 | A | 2/2013 |
| NL | 70813 | C | 8/1952 |

* cited by examiner

E-E' CROSS-SECTION OF THE FIG. 4

TOP VIEW OF THE CROSS-SECTION OF THE FIG.3, FOLLOWING THE PLAN P

Detail C of the fig.6

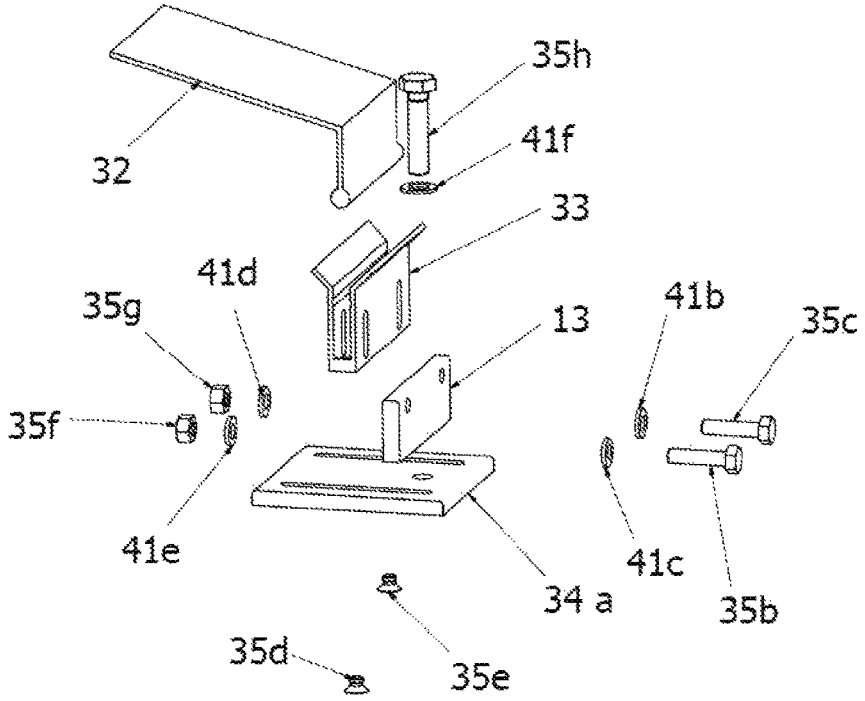
FIG. 8
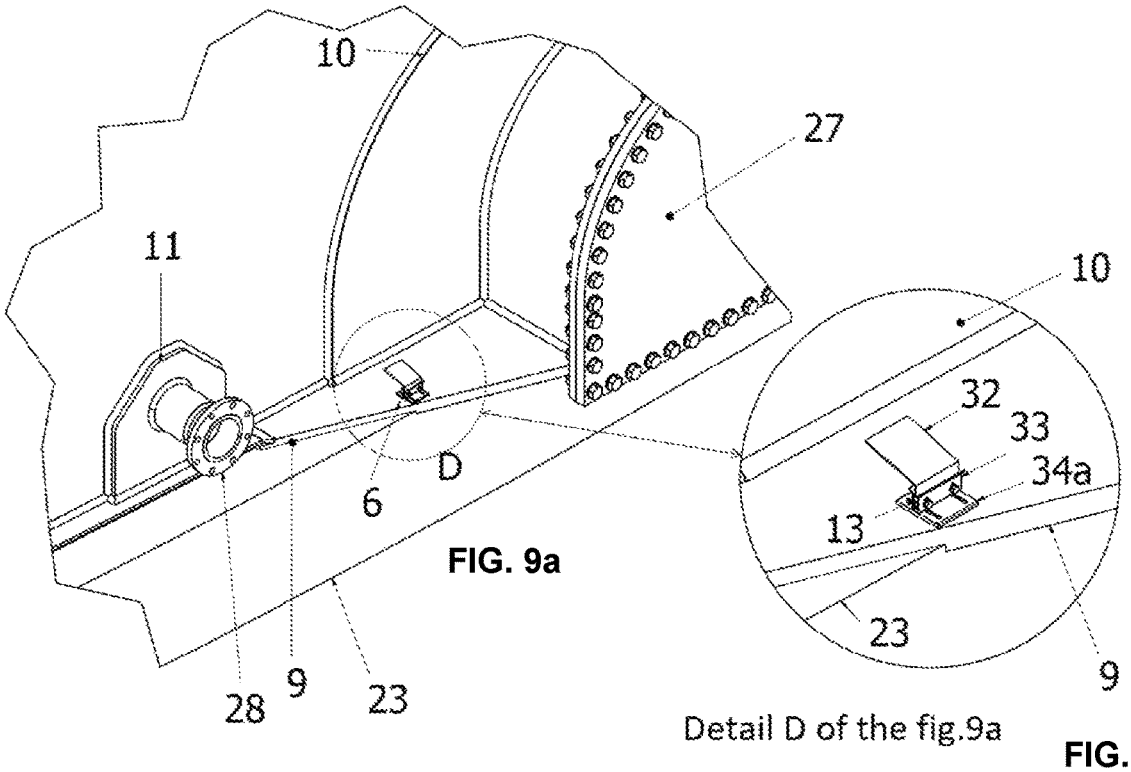
FIG. 9a
FIG. 9b

DEFLECTOR FOR PROTECTING THE FEET OF A STRUCTURE

CROSS REFERENCE TO RELATED APPLICATION

The present disclosure is related to French Patent Application Publication 3002927 filed by the Applicant on Mar. 6, 2013, the entire contents of which are herein incorporated by reference.

TECHNICAL FIELD

The technical field of the disclosure is the construction of structures such as storage tanks.

BACKGROUND

Storage tanks or more commonly referred to as "bins" are generally used to store products such as oil and the derivatives thereof; acids, water, etc.

Storage tanks are generally made from carbon steel and are subject to external corrosion located at the bin foot (see FIG. 2), in line with the connection angle welds of the lower ferrule (14) and of the annular edge, under the marginal plate (15).

The entire bin is installed, on a slab constituted by multiple layers, a compacted backfill (22) covered with a sealed membrane (20), which itself is covered with a bituminous sand (21), the whole is surrounded by a concrete ring (23), even installed on a complete concrete slab or can be installed on the concrete retaining bowl.

Finally, resting on this support assembly, are the bottom plates of the tank welded to the marginal plates and ferrules of the tank which make it possible to contain the product inside the bin.

These tanks can measure in France up to ninety metres in diameter and have a height that can reach around twenty metres.

Stainless steel tanks cannot be corroded but their concrete supports can also be damaged and, are consequently concerned by the presently designated equipment. They are also subject to the fatigue mentioned hereinbelow.

Other elements are to be taken into consideration relating to the confinement losses of a storage bin. The loading/unloading cycles which are weakening factors for welded connections. These weakenings can lead to the rupture of the bin bottom and then generate a leak that can be detected from outside the tank.

To date, there can be fixed deflectors that are used to deviate rainwater or fire water, during actual tests, conducted by the fire brigade and consequently, protect the structures.

Bin manufacturers do not in general integrate the installation of a deflector on the bin feet which is an accessory, not a bin structural element.

Only the quality, corrosion, inspection departments recommend the positioning of this protection, in order to preserve the integrity of the bin.

The main field of use for the deflector, commonly referred to as the "bib", is located on all the storage tanks, regardless of their uses or the quantity of product stored.

Using this protection is not limited to the storage of oil but to all structures that require the need of maintaining integrity.

Most tanks are not equipped with deflectors, others are equipped but in a definitive manner with fixed steel plates, welded onto the first ferrules to the foot of the bin, which prevents any automated controls under the deflector and does not facilitate the visual inspection of the structure foot.

The installation of these protections is very constraining and, is generally carried out during the construction of the bin or during ten-year visits or during an opportunity shut-down, thus allowing for the welding of supports of the deflector.

Indeed, no "hot" work by welding for example, must be carried out while a storage bin is in use.

Other methods of protection, other than the welded bib, are proposed such as the application of a bituminous coating with an aluminium support or epoxy coatings, or even recommendations of construction codes, proposing the installation of a deflector at the marginal plate edge but, all these propositions do not allow for the inspection of areas subject to degradations and, cannot result in observances of any leaks coming from the bin bottom.

Indeed, the minimum conditions for installing these deflectors must meet the following needs:

- protecting the bin foot by preventing the migration of rainwater under the marginal plate.
- allowing for inspection and controls of the bin foot.
- allowing natural ventilation that is sufficient for the drying of the area.

A tank foot that is degraded via corrosion increases the risk of the bin opening and regardless of the product stored, can cause damage to equipment and people and, generate substantial financial losses.

The first problem is that a leak at the bin bottom, on the welds of the bottom plates and the bottom plates themselves or, in line with the connection angle welds of the lower ferrule and of the marginal plates, can be concealed by the application of an exterior coating.

Also, there is no investigation system that is 100% reliable, such as an acoustic emission, in order to overcome the state of the integrity of the bin bottom. Indeed, the results are often skewed by the presence of paraffin in the bin bottom, in the case of a storage of a hydrocarbon.

All of the propositions and tests currently carried out do not meet the minimum conditions recommended to allow for the carrying out of inspection visits, while still preserving the integrity of the protected equipment.

The second problem is that for the bins that are equipped with welded deflectors, the interventions only allow for maintenance and servicing actions but not the replacing of equipment during the period of use in production.

The only means of intervention for major replacement work or hot work repairs is during a production shut-down period or regulatory ten-year visit.

For bins that are not equipped with deflectors, the problem that arises is the installation of these protections, with the bin in service. It is impossible to install a deflector via welding. The outcome of this situation is the application of a coating but which rests unsuitable since it masks possible leaks coming from underneath the bin bottom.

BRIEF SUMMARY

The disclosure addresses the following: —the absence of a real fastening of the deflector because the retaining arms are fixed to the wall only by magnets and the support arms only press against this via simple contact

- the weakness of the force of the pressing of the gasket on the cover/wall of the tank, because the seal is flush on this wall by the simple fact of the positioning of the protective plate and of the retaining of the latter by the magnets;

the magnetic force is difficult to predict on the one hand according to the state of the plate of the tank and on the other hand according to the loads applied on the protective plate and which depend:

on the countries in which the equipment is installed, according to the local weather conditions locales such as torrential rain, snow, freezing, sand, wind, etc.;

on the density of the products used such as for conducting fire tests;

on the risk of magnets falling off due to impact during maintenance interventions or scheduled visits;

the initial slope of the deflector multiplies the number of obstacles encountered during the mounting. From this stems a multiplication in the work to be carried out and the risks of infiltration, cutting, installation and connections of sealing gaskets.

In light of the difficulties encountered, mentioned in the preceding patent, to install or repair via welding the protections of marginal plates, during the use of the bins and, of the lack of effectiveness or of the occultation caused by the presence of coatings of structural feet (and which have been resolved by the latter) and, of those mentioned hereinabove in the new improved patent application.

One solution to the problems posed is the installation of a deflector, to protect the feet of the metal wall of the structure resting on a support slab (such as made of concrete) or support sole, from liquid infiltrations, including:

at least a protective plate downward-sloping away from said wall when the deflector is in the operational position;

at least one flexible sealing gasket attached along the upper edge, when the deflector is in the operational position, of this protective downward-sloping plate and able to come into sealed contact against said structure wall of which it hugs the shape;

at least one retaining arm of the plate wherein one of its ends is fixed to the deflector towards the so-called upper edge of said plate and the other so-called distal end, is able to be together linked or attached to an element of said structure, such as the wall of the latter in a reversible manner and to be detached therefrom, making the deflector removable and, such as according to the present disclosure:

said retaining arm is a pressing arm of the plate, able to press the sealing gasket of the upper edge of the latter against the wall of the structure when the deflector is in the operational position, and this deflector further includes:

at least one support arranged towards the lower edge of the plate when this plate is installed around the structure to be protected (i.e. when the deflector is in the operational position), and can be separated into at least two portions able to make the deflector removable, of which the upper one is fixed underneath the plate and the other lower one to support slab of the structure wall or, to the reinforcing sole of any accessory of this structure such as a cleaning door.

According to preferred embodiments of the disclosure, two solutions are then possible for the carrying out of this pushing arm according to on the one hand the state of the ring or of the concrete slab, whereon presses the structure for which it is desired to protect the wall foot, as well as the quality of the surface condition and of the nature of the material of this wall of the structure, and on the other hand either according to the possibility of prefabricating the plates of the deflector so that they are adapted to the structure concerned (for example by taking a template) or having to be adapted on site to this structure during the installation of the deflector:

the first solution, especially interesting when the concrete ring is degraded at the foot of the wall of the structure and/or the wall of the tank makes it possible to be fixed therein in a reversible and non-invasive manner for the wall and/or when the latter has to be adapted on site, is that the retaining arm, which is therefore according to the disclosure a pressing arm, of the plate is located above this plate, presses on it from the top when the deflector is in the operational position and includes at its distal end at least one reversible and non-invasive means of fastening for the wall, such as a magnet or suction cup, able to be magnetically linked, or through the aspiration effect or other, to the wall;

the second solution, especially interesting when the concrete ring is in good condition and the plate of the deflector can be prefabricated so that it is adapted to the structure (which is the case for example of brand new structures) is that the retaining arm, which is therefore according to the disclosure a pressing arm located below this protective plate and which can be separated into at least two portions (the upper one is fixed underneath the plate and the other lower one to the support slab of the structure wall or, to the reinforcing sole of any accessory of this structure), the ends of said parts facing one another being able to be snap-fitted together by pressing one against the other and moving one in the other (see an example hereinafter of this definition of snap-fitting and as shown in FIG. 10) during the positioning of the deflector and to stay linked together despite their setting into traction by the reaction of the sealing gasket which is compressed during the snap-fitting thereof, but these ends of said parts facing each other being able to be unclipped and therefore detached by an superior force of setting into traction.

Moreover regardless of the embodiment retained for the pressing arm, according to the two solutions hereinabove, and according to particular embodiments of the disclosure:

the deflector plate, when the latter is in the operational position, has a slope that allows a flow of liquid without retention and a resistance to the vertical load of the liquid;

the deflector according to the disclosure includes a vertical edge, along the lower edge of said sloping plate when the deflector is in the operational position;

a deflector assembly is constituted by several deflector elements, having the characteristics hereinabove, all independent from one another but able to be positioned one after the other in a continuous manner around and against the feet of the wall of the structure in order to protect the entire periphery of it;

the deflector assembly is constituted by deflector elements including at least, along one of the side edges thereof, covering elements and able to cover the empty space until the adjacent element.

the supports, disposed towards the lower edge of the plate, as well as the pressing arms, disposed towards the upper edge thereof, can be adjusted in order to be able to regulate and adjust the height of the sloped protective plate with respect to the slab or the concrete ring, and retain on the one hand this plate pressing on the wall of the structure to be protected and on the other hand in a sloped position according to the desired angle.

The disclosure is therefore as in the preceding patent application, the installation of a removable deflector, which designates in the present description either a deflector element or a deflector assembly comprised of several deflector elements, and such as specified hereinafter.

With the innovation being the fact that the protection is removable and, that it is therefore not necessary to shut down the production of a bin in order to install the protection and also, the improvements provided such as described hereinafter and which make it possible:

- in the case of pressing arms located above the protective plate and that can be detached, magnetically or otherwise, from the wall thanks to magnets or other reversible and non-invasive means of fastening for the wall:
- the position of the magnets, or other means, articulated which are located in this case above the protective plate, which provides easier access to the handling of the latter;
- the magnets (or other reversible means of fastening) no longer have the same functions as in the preceding patent. They are no longer used as supports for the retaining in height of the protective plate but, now make it possible to retain the plate and its sealing gasket flush with the structure to be sealed;
- the retaining arm includes a turnbuckle able to adjust the pressure to be exerted for the pressing of the sealing gasket;
- the retaining arm is articulated to its two ends by axes inserted into end-pieces allowing for a rotation of the whole so as to make it possible to disconnect the magnet (or other reversible means of fastening) from the wall of the structure;
- the turnbuckles are also used as handles for the mounting/dismounting protective plates;
- in the case of pressing arms located below the plate and which can be detached by unclipping these two supports:
- the simplification of the manufacturing which allows for industrialisation (for example, the deflector plate can in this case be carried out by stamping in a single piece, and there is no element attached to this plate other than the sealing gasket and the fastening of the arms and supports),
- the rapidity of the implementation during mounting/dismounting of the elements while still ensuring the tightness in the areas constituted by multiple angles such as the sides of the cleaning doors,
- in this solution all of the particular points, such as tappings, cleaning doors, stairs, etc., can be protected either according to the descriptions disclosed hereinafter or preferably for a decrease in costs, by fixed protection, installed on supports, covered with a sealing product and which does not prevent the carrying out of manual or visual controls through the side of these fixed elements,
- there then only remains, once the particular points are protected, to place the "standard" removable sections defined hereinabove and such as shown in FIG. 10,
- standardisation of the dimensions of the deflector plates makes it possible, in terms of dimensions and weight, the optimisation of loads during transport,
- the yield generated by the stamping of standardised plates provides substantial reactivity to an order,
- and therefore the simpler it is, the faster it is also to mount, and the more the cost goes down for the overall protection, the more marketable it is,
- Regardless of the solution chosen for the carrying out of the pressing arms
- the positioning of adjustable supports, fixed to the ring or concrete slab or to the reinforcing sole of the cleaning door, such as via a suitable glue or screwed, makes it possible to absorb the external loads, without detaching any further, as in the case with pressing arms fixed to the wall of the structure above the protective plate, magnets (or other reversible means of fastening) of the structure to be protected;
- the supports of the deflectors, which can even be adjusted according to three axes, are able to adjust the vertical or horizontal space between the deflectors in their operational positions, these axes for adjustment are:
- the axis of the lateral slide of the part (rounded portion) in a guide;
- the axis of the sliding in height of the part on a slider;
- the axis of the sliding in translation of the slider on the base.
- the position of the supports makes it possible to block the foot of the deflector and thus, gives the possibility of increasing the load exerted on the deflector and consequently, increasing the pressing of the gasket on the wall and therefore improves the tightness of the area to be protected during inclement weather or fire tests.

The retaining arm (5) is in the background and, is located outside (24) the tank.

Figure 3:
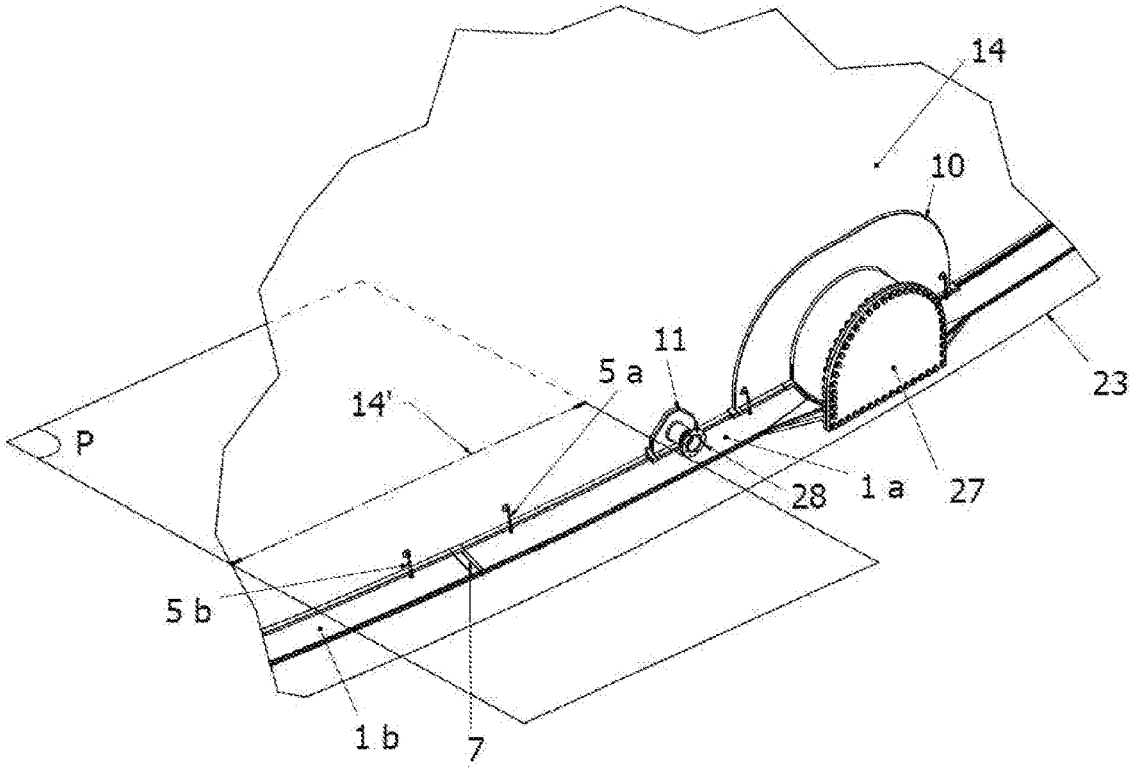

FIG. 3 is a general view in perspective making it possible to locate the solutions of the disclosure at the presence of obstacles such as the cleaning door (27) and its reinforcing plate (10) or a drain tapping (28) and its reinforcing plate (11).

This figure also makes it possible to locate the cutting plane P (of FIG. 4) positioned on the ferrule of the tank along its intersection (14') with the latter.

Figure 4:
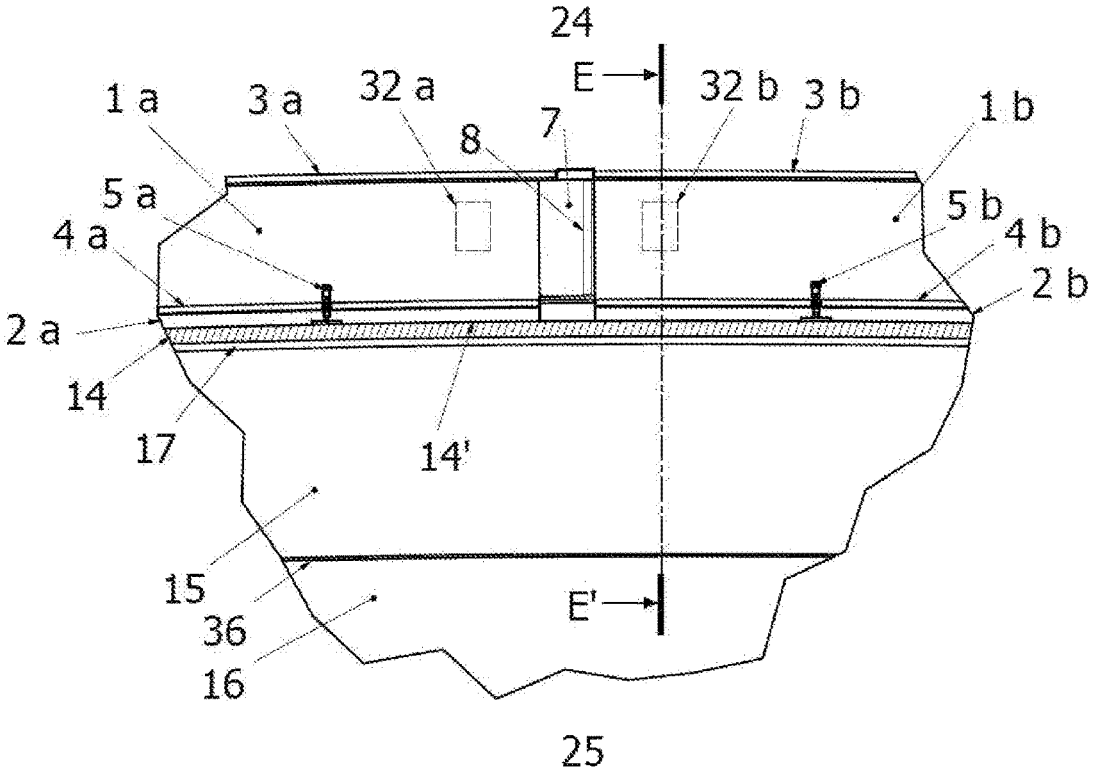

FIG. 4 is a top view of the section along a plane P of FIG. 3 locating the ferrule of the tank (14) in section and its interior weld (17) in connection with the marginal plate (15) which is also welded (36) to the bottom plate (16), the deflectors (1*a*) and (1*b*) visible in (FIG. 3), the position of the adjustable supports (32*a*) and (32*b*) installed under the deflectors, the wall sealing gaskets (2*a*) and (2*b*), the anti-drip profiles (3*a*) and (3*b*), the arched profiles (4*a*) and (4*b*), the retaining arms (5*a*) and (5*b*), the cover plate (7), the sealing gasket (8) placed under the cover plate and the position of the section E-E'.

Figure 5:
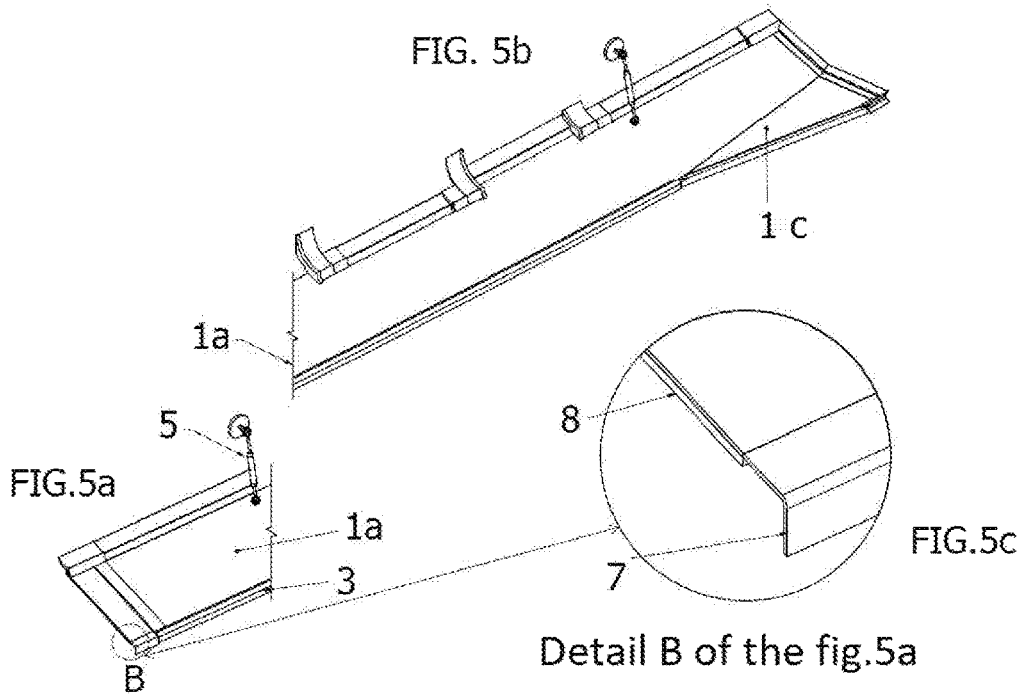

FIG. 5 is a general view of one of the deflectors installed on the side of the cleaning door (FIG. 3 27).

This view makes it possible to show the installation in front of potential obstacles.

FIG. 5*a* shows the standard section used for most deflectors;

FIG. 5*b* shows the assembly carried out in order to respond to the presence of obstacles such as for a cleaning door such as shown in FIG. 3;

FIG. 5*c* shows the detail B of FIG. 5*a* which makes it possible to locate the position of the lateral sealing gasket (8) of the cover plate (7).

Figure 6:
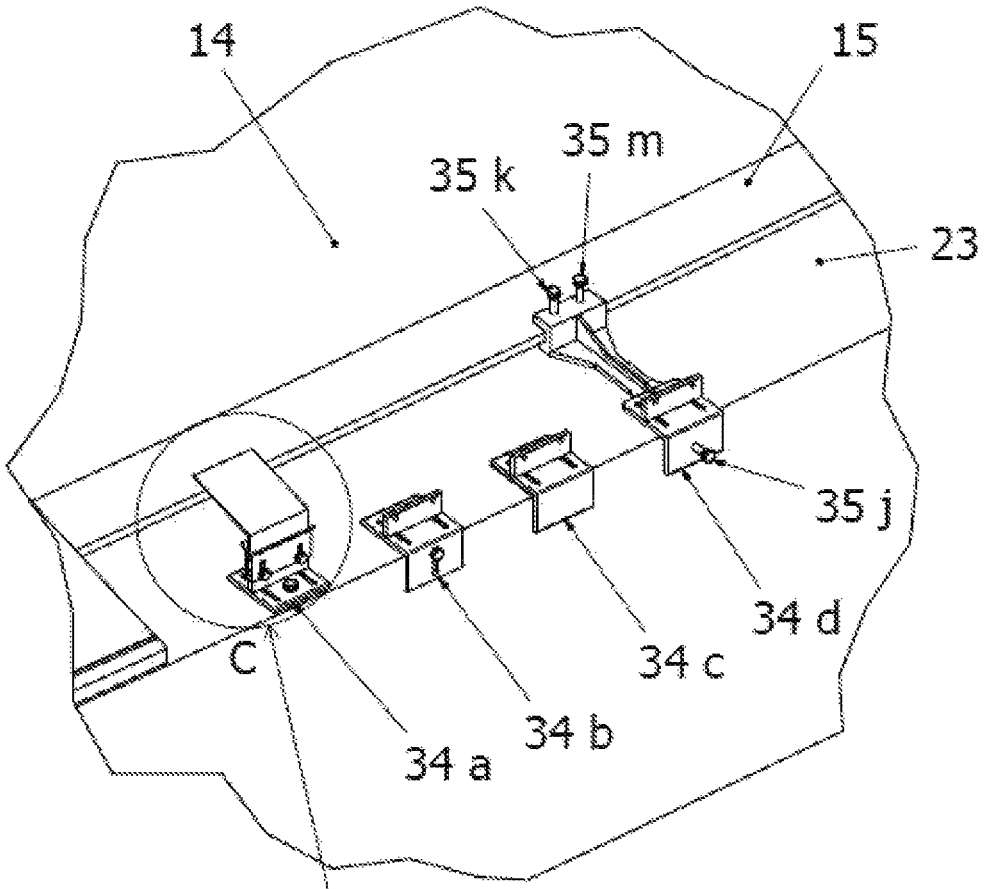

FIG. 6 shows a view of the different possibilities of carrying out supports of deflectors and which are disposed towards the lower edge of the protective plate, but which can also be carried out in at least two parts able to be snap-fitted together by pressing one against the other and moving one in the other as for the second solution of the embodiment of the pressing arm described hereinabove and shown in FIG. 10;

Base support (34*a*)—assembly fixed by the top of the concrete ring or sole;

Base support (34*b*)—assembly fixed by the belt of the concrete ring;

Base support (34*c*)—assembly glued by the top and the belt of the concrete ring;

Base support (34*d*)—assembly fixed by screws on the marginal plate (15) and retained by another screw on the belt of the concrete ring.

Figure 7:
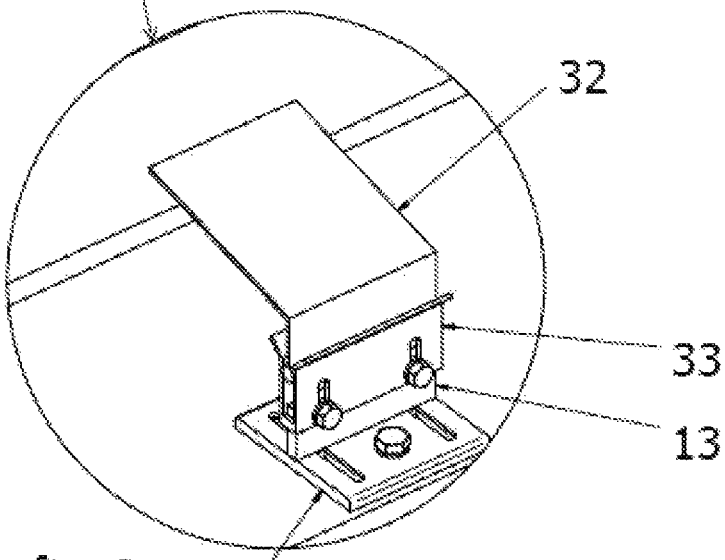

FIG. 7 is view of the detail C of FIG. 6 showing the elements that constitute the support (34*a*) bolted onto the concrete ring in the operational position.

FIG. 8 is an exploded view of the support (34*a*) of FIG. 6.

FIG. 9*a* is a general view of the installation with the reinforcing sole and the cleaning door with the location of one of the two supports glued and installed on the reinforcing sole of the cleaning door (9).

FIG. 9*b* is a view of Detail D of FIG. 9*a*.

Figure 10:
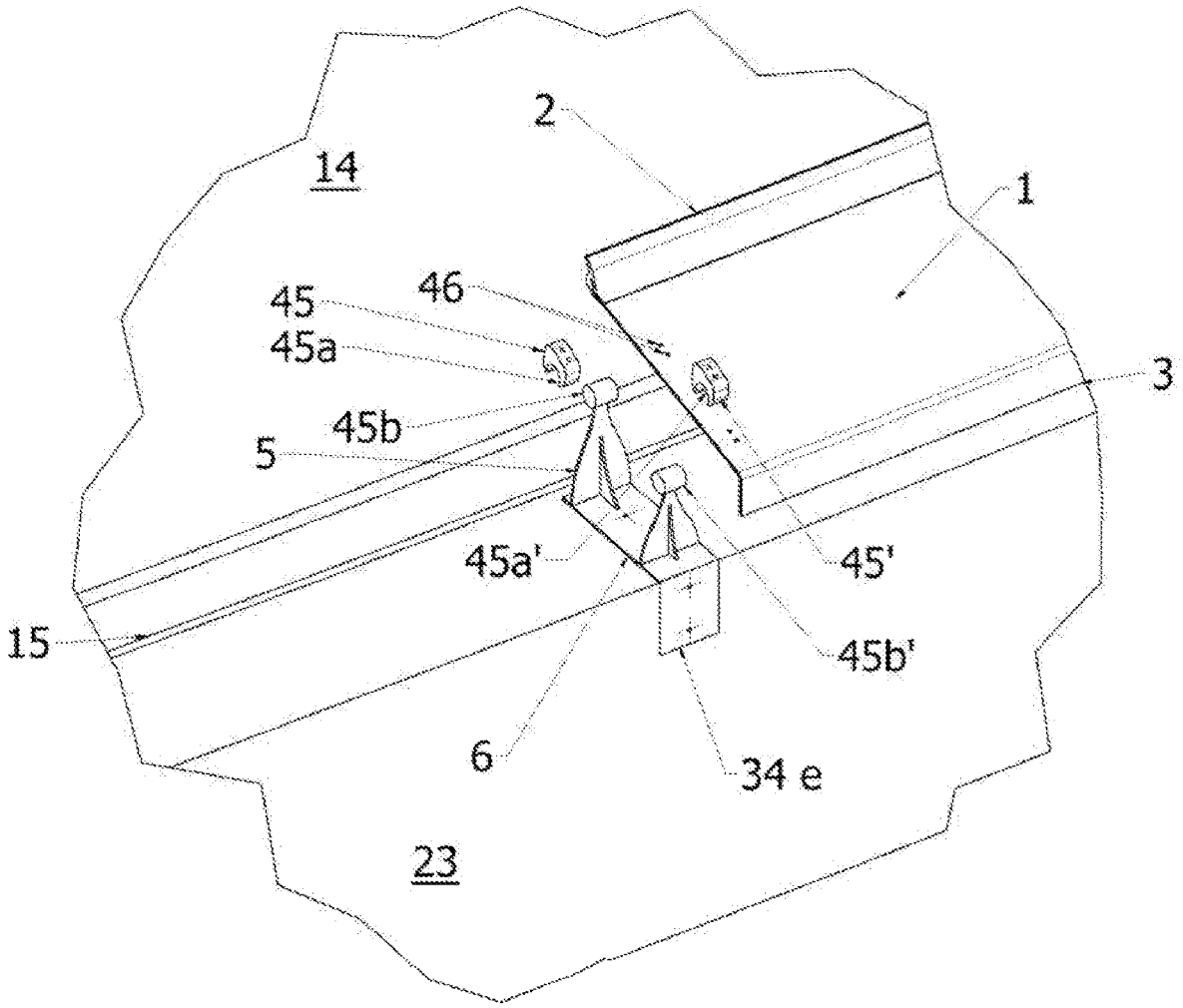

FIG. 10 is a diagrammatical view in perspective of all of the deflector according to the disclosure, in a mounting situation on site and partially exploded, according to the second solution of the embodiment of the pressing arm located below the protective plate of the deflector.

DETAILED DESCRIPTION

In reference to these drawings:

The deflector assembly is constituted by several deflector elements (FIG. 3 ref 1*a* 1*b*) independent from one another but able to be positioned one after the other in a continuous manner around and against the feet of the wall (FIGS. 1, 2 and 10 ref 14) of the structure.

The deflector assembly presses on the seat of the tank (23) and, is retained to the latter by supports (6), that can be adjusted according to three axes, and able to adjust the vertical or horizontal space between the independent deflector elements in their operating positions.

Each deflector element (FIG. 3 ref 1*a* 1*b*) that constitutes the deflector assembly includes at least, along one of the side edges thereof, covering elements (FIG. 4 ref 7) and (FIG. 4 ref 8) able to cover the empty space until the adjacent element.

The deflector (FIGS. 1 and 10 ref 1) is mainly constituted by a protective plate formed on two faces.

The faces have two angular positions. A sloped face at minimum of 15° (FIGS. 1 and 10 ref 1), and a revolution suitable for the radius of the tank and, an anti-drip profile with vertical edge in the lower portion (FIGS. 1 and 10 ref 3), limiting the flow towards the ground or culvert (FIG. 2 ref 26).

The slope of a minimum of 15° of the deflector (FIGS. 1 and 10 ref 1) makes it possible to prevent having to pass under the major portion of the elements fixed to the storage tank, stairs, tappings, etc.

However, the shape and the slope of the deflectors can be modified according to the obstacles encountered such as, the cleaning door (FIG. 3 ref 27) or the presence of reinforcing plates (FIG. 3 ref 10 11) welded to the wall (14) of the tank and, of any other existing elements on site.

As indicated hereinabove, obstacles can hinder the positioning of the deflectors, the deflector plates (1) are then cut out and the installation of a nitrile gasket can ensure the tightness of these particular areas.

Figure 1:
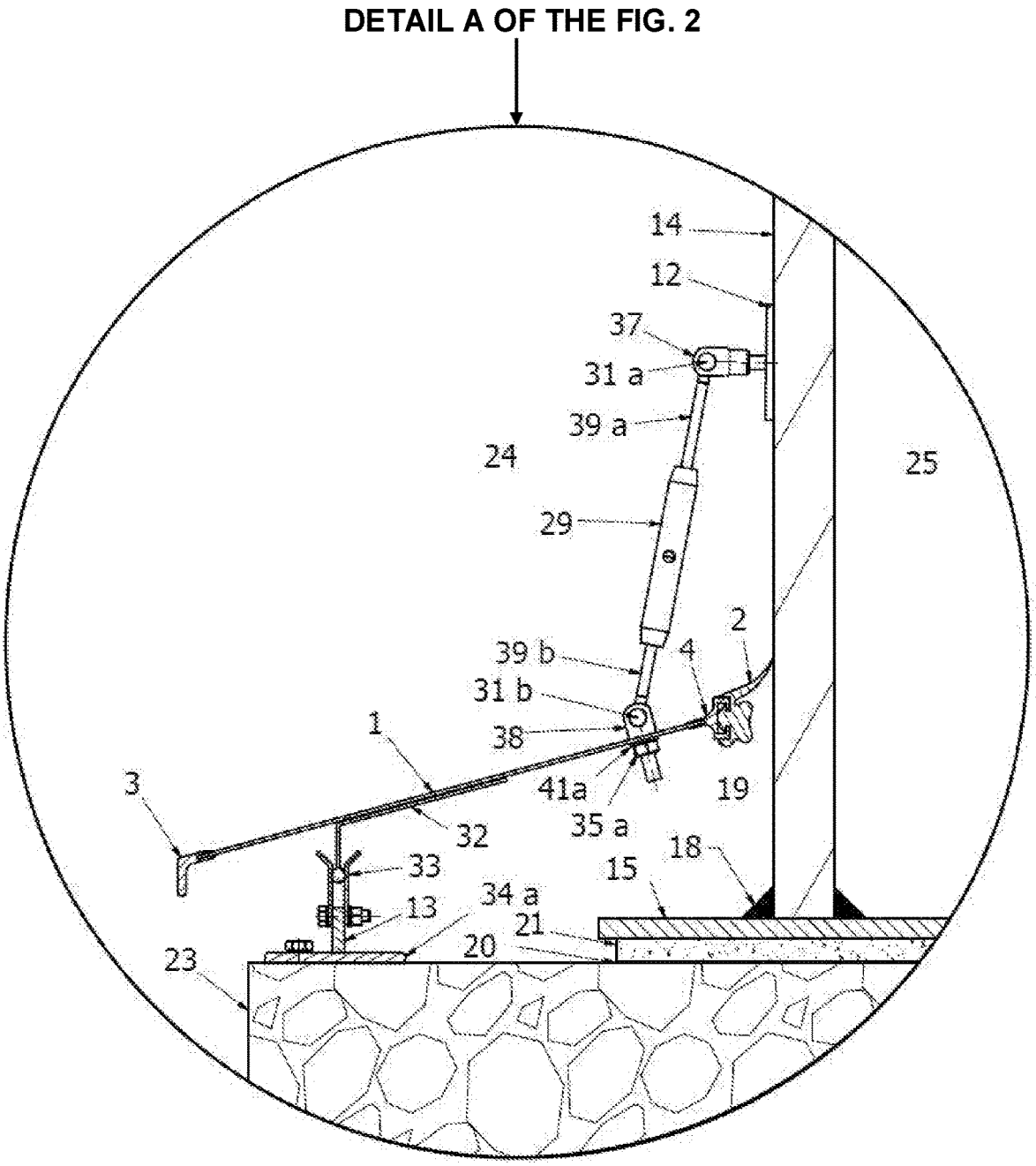
FIG. 1 is a view, according to the first solution of the embodiment of the pressing arm located above the protective plate of the deflector, of the detail A of FIG. 2 making it possible to locate the elements, constituting the disclosure placed outside (24) the tank.
Figure 2:
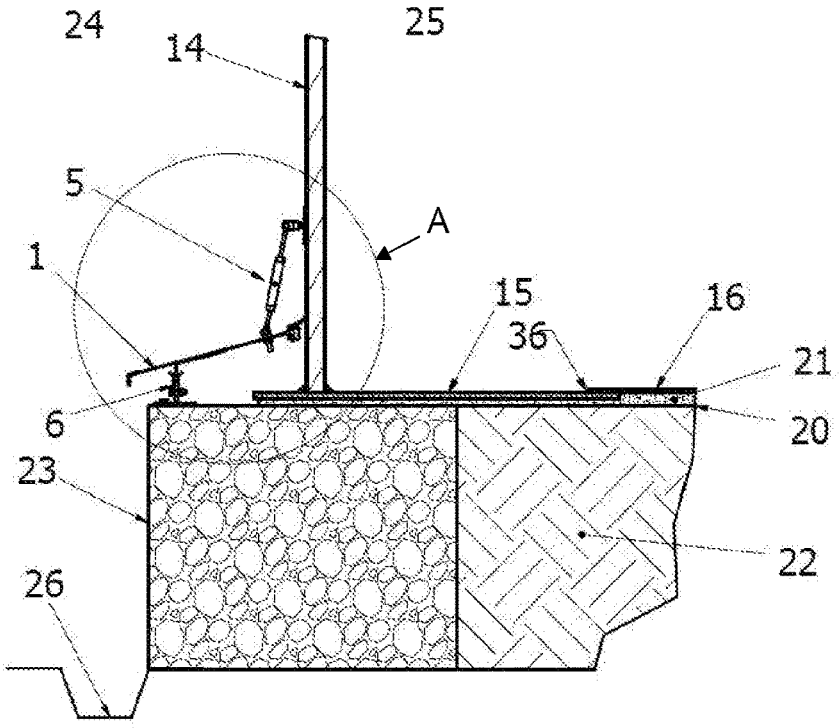
FIG. 2 is a view, according to the same first solution as FIG. 1, of the section E-E' according to FIG. 4 of the bin ferrule (14) whereon the deflector is placed. Also locating the support bas of the tank and the welded connection (36) of the marginal plate (15) and of the bottom plates (16) located inside (25) this tank.

According to the first solution of the embodiment of the pressing arm according to the disclosure and as shown in FIGS. 1 and 2, this pressing arm is located above the protective plate of the deflector, and this sloping plate (1) is equipped with this retaining/pressing arm (FIG. 2 ref 5) (visible in the background) used in the first place for retaining the deflector (1) in its operating position and, in the second placed for adjusting the pressure required for the correct application of the gasket (FIG. 1 ref 2) on the wall (14) of the tank.

The retaining arm is articulated at its two ends by axes (FIG. 1 ref 31 *a* 31 *b*) inserted into end-pieces (FIG. 1 ref 37 38) allowing for a rotation of the whole so as to disconnect the magnet (or other reversible means of fastening) (FIG. 1 ref 12) from the magnetic wall (14).

The end-pieces of the retaining arm are on its lower portion and deflector side, bolted (FIG. 1 ref 35*a* 41*a*) and on its upper portion, provided with the magnet (or other reversible means of fastening) (FIG. 1 ref 12)

All of the elements that constitute the retaining arm are attached to the turnbuckle (FIG. 1 ref 29) by devises (FIG. 1 ref 39*a* 39*b*), which makes it possible to carry out an adjustment by rotation of the turnbuckle so as to obtain good application of the gasket (FIG. 1 ref 2).

The turnbuckle (FIG. 1 ref 29) is the element that makes it possible to refine the application of the gasket (FIG. 1 ref 2) on the wall (14), by screwing/unscrewing.

The last use of these retaining arms (5) is for the handling of the deflectors during the installation thereof, these arms can have the function of transport handles.

The retaining arms (5) are located above the deflector (1), when the deflector is in the operational position, and are able to come into contact against the wall (14) above the sealing gasket (FIG. 1 ref 2) by a rotation on its axis (FIG. 1 ref 31 *b*).

The deflector intended for a metal structure wall (14) is such that, at least the retaining arm (FIG. 2 ref 5) includes at its distal end at least one magnet (or other reversible means of fastening) (12) able to be made integral magnetically with the wall (14).

According to the second solution of the embodiment of the pressing arm according to the disclosure, as shown in FIG. 10, the pressing arm (5) is located below the protective plate: it can be separated into at least two parties, the upper one (45) being fixed (46) underneath the plate (1), such as by screwing, and the other lower one of which the distal end is fixed to the support slab of the structure wall or to a base support (34*e*) (such as by welding such as shown in FIG. 10), or, to the reinforcing sole of any accessory of this structure.

And in this second solution, the ends (45*a*, 45*b*) of said parts facing one another being able to be snap-fitted together (45*a*, 45*b*) by pressing one against the other and moving one in the other during the positioning of the deflector and to retain integral between them despite their setting into traction by the reaction of the gasket which is compressed during the snap-fitting thereof, but these ends (45*a*, 45*b*) of said parts facing each other being able to be unclipped and therefore detached by an superior force of setting into traction.

An embodiment of these parts that can be snap-fitted is diagrammatically shown in FIG. 10 wherein one (45*a*), located on the side of the upper portion (45) of the pressing arm (5), has its end in the form of a partially open ring and able to open a little more elastically in order to receive the end of the other (45*b*), located on the side of the lower portion of the arm (5) and which is in the form of a cylinder then being housed in said ring and being blocked therein by the effect of the closing of the latter at the rear of the cylinder; in other embodiments, these shapes as a cylinder and as a partially open ring can be inverted, the end of the upper portion (45*a*) able to be in the form of a cylinder and that of the lower portion (45*b*) in the form of a partially open ring.

In order to make the deflectors able to be transported, the whole of the deflector is cut into sections of a length suitable for easy human transport thus preventing the intervention of equipment in the bowl of the tank.

The material of the deflector is made from stainless steel, aluminium or from galvanised steel or other, according to the requests of the customer.

The plates of the deflectors according to the disclosure include a vertical edge (3), along the lower edge of said sloping plates when the deflector is in the operational position: this edge can either be a gasket so called anti-drip profile (3, 3*a*, 3*b* according to FIGS. 1, 4 and 5), or a simple folding of the plate (1) itself (according to FIG. 10).

The elements installed on a bin or in a bin bowl must not be one of the three elements of the fire triangle.

The tightness between the deflector and the wall of the tank (FIGS. 1 and 10 ref 14) is carried out using a nitrile gasket (FIGS. 1 and 10 ref 2) or other material adapted to the environment, inserted into an arched profile (FIG. 1 ref 4) which itself is nested in the plate (1) of the deflector.

The tightness between the deflector and the wall of the cleaning door (FIG. 3 ref 27), as an example and when it is also desired to use a removable deflector element, retains the same principle for positioning as that mentioned hereinabove but, by using profiles of gaskets and of rails (profiles) of different shapes and sizes (FIG. 5*b* ref 1*a* 1*c*).

Each element of the deflector assembly that constitutes it includes a plate (FIG. 3 ref 7) (FIG. 4 7) (FIG. 5 ref 7 detail B) and a cover gasket (FIG. 4 ref 8) (FIG. 5 ref 8 detail B) along one of the side edges thereof and able to cover an adjacent element.

A cover plate (FIG. 4 ref 7) is welded on the protective plate (FIG. 4 ref 1*a*) thus making it possible to fill in and protect the empty area between the protective plates (FIG. 4 ref 1*a* and 1*b*).

A cover gasket (8), according to (FIGS. 4 and 5), provides the tightness between two deflector elements in the operational position.

The adjustable supports (FIG. 2 ref 6) (FIG. 9*a* ref. 6) are on the one hand, fixed (FIG. 7 ref 32) to the deflectors such as by welding or screwing/bolting and on the other hand, fixed to the concrete ring (FIG. 2 ref 23) either by gluing, or by screwing or fixed on the steel reinforcing sole (FIG. 9*a* ref 9) of the cleaning door by gluing, according to the location where the support is installed and according to the recommendations of the customer.

Four parts constitute the adjustable support model 34*a* as an example (FIG. 6, 7, 8):

- The base of the support, a T profile (FIG. 8 ref 34*a*) fixed on the concrete ring (23) or the reinforcing sole of the cleaning door (FIG. 9*a* ref 9), or by a suitable glue or by a screwed fastening.
- A slider (FIG. 8 ref 13) allowing for a movement in translation of the support. Two screws (FIG. 8 ref 35*d, e*) passing through the base of the support by the grooves, retain the part in the position of use.
- A sliding guide (FIG. 8 ref 33), provided with oblong holes, makes it possible to adjust the height of the deflector so as to adjust the protective elements one to the other.
- A folded plate (FIG. 8 ref. 32) welded under the plate (1) of the deflector, the rounded lower end of this element is clamped in the guide mentioned hereinabove and makes it possible to retain in position the deflector after adjusting and tightening of the bolts (FIG. 8 ref 35*b, c, d, e, f, g, h*) and (FIG. 8 ref 41 *b, c, d, e, f*).

Several types of supports can be used to fasten the deflector plates. As an example in the diagram (FIG. 6):

- Base support (34*a*)—assembly fixed by the top of the concrete ring (23) or reinforcing sole (9).
- Base support (34*b*)—assembly fixed by the belt of the concrete ring (23).
- Base support (34*c*)—assembly glued by the top and the belt of the concrete ring (23).
- Base support (34*d*)—assembly fixed by screws (FIG. 6 35*k, m*) on the marginal plate (15) and retained by another screw (FIG. 6 35*j*) on the belt of the concrete ring (23).

The supports of the deflector elements designated hereinabove (6), must make it possible to carry out an adjustment on three axes, so as to adjust the vertical or horizontal space between the deflector elements in the operating positions thereof.

According to the embodiment of FIG. 10, a single base support (34*e*) can be fixed to the concrete ring (23) (such as by screwing on the side of this ring (23) as shown in this FIG. 10) and support the distal ends of the lower portions of the support (6) of the protective plate (1) and of the retaining/pressing arms (5) of this plate (1), the upper portions (45, 45') of this support (6) of plate (1) and of the arm (5) being fixed (46, 46') by screwing/bolting/riveting (or other means) on the bottom of the inclined protective plate (1); the supports (6) of plate (1) can be adjusted such as in the embodiments described and shown in FIGS. 1, 7 and 8, or can be snap-fitted (45*a*', 45*b*') as shown in FIG. 10 and according to the same characteristics as described for the snap-fitting of the ends (45*a*, 45*b*) of the two portions that can be separated of the pressing arms (5) described hereinabove.

In order to standardise the manufacture of these snap-fitting parts and therefore simplify it, the upper portions (45, 45') respectively of the supports (6) and of the arms (5) can be identical and fixed under intermediate parts integral with the underside of the protective plate (1), these parts (not shown in the example of FIG. 10) being of different heights in order to offset the difference in heights between the arms (5), higher, and the supports (6), lower, so that the lower portions of these arms and of these supports are also identical.

The alternatives for manufacturing and for mounting are multiple.

The deflectors can be used on all structures that require a protection and a maintaining of integrity.

The materials used for the carrying out of the deflector elements (1) can be zinc, Plexiglas or a plastic if the risk of fire is not proven and according to the conditions of use.

The alternative can be done on the thicknesses of the materials used, their weight and their costs.

The sealing gaskets can be made from any flexible and extrudable product so as to hug the area to be made tight and facilitate the insertion of the latter into a support profile.

The magnets can be of variable shape, as a horseshoe, cylindrical or parallelepiped, and even have a predefined shape at the time of order and can be used for the retaining arms as well as for the supports.

The fastenings to the non-magnetic walls can be carried out with suction cups or glued plates, or fixed by any other reversible means of fastening, to the walls of the structure according to the nature of the support whereon the deflector has to be installed.

The first interest of this protection is the fact that the latter is removable but also, through this fact, can allow for the passage of control equipment on the structure such as:

- Measurements of thickness of ferrules by robots. These robots are provided with magnetic tracks which allow them to move the foot of the bin until the last upper ferrule;
- Measurements of the losses of thicknesses of the marginal plates taken by a robot that moves horizontally on the bin foot;
- Measurements of standard thicknesses via ultrasonic inspection, carried out manually by technicians equipped with ultrasonic sensors;
- The ACFM Alternative Current Field Measurement control consisting in controlling the quality of external connection welds (FIG. 1 18), of the first low ferrule of the shell of the bin with the marginal plate.

Some of these controls are carried out during three-year visits and other during ten-year visits. However, the essential need remains the possibility for visual inspection of the bin foot (FIG. 1 ref 19) which can be done at any time, as much as necessary according to current legislation.

The invention claimed is:

1. Deflector for protecting feet of a wall of a structure resting on a slab, from liquid infiltrations, the deflector comprising:

- a protective plate, downward-sloping away from said wall when the deflector is in an operational position.
- a flexible sealing gasket attached along an upper edge of the protective plate, and disposed in sealed contact against said wall when the deflector is in the operational position;
- a retaining arm having one end fixed to the deflector towards said upper edge of said protective plate and another end, removably linked with an element of said structure;
- wherein said retaining arm is an arm for pressing the protective plate so as to press the sealing gasket of the upper edge of the protective plate against the wall of the structure when the deflector is in the operational position;
- wherein the arm for pressing the plate is located above the plate and presses on the plate from the top when the deflector is in the operational position;
- the deflector further comprising a support disposed toward a lower edge of the protective plate, separable into two parts to make the deflector removable, of which an upper part is fixed underneath the protective plate and a lower part is fixed to the slab or to a reinforcing sole of an accessory of the structure.

2. Deflector according to claim 1, wherein the retaining arm includes at the distal end thereof a magnet able to be magnetically linked to the wall.

3. Deflector according to claim 1, wherein the retaining arm includes a turnbuckle able to adjust the pressure to be exerted for the pressing of the sealing gasket.

4. Deflector for protecting feet of a wall of a structure resting on a slab, from liquid infiltrations, the deflector comprising:

- a protective plate, downward-sloping away from said wall when the deflector is in an operational position.
- a flexible sealing gasket attached along an upper edge of the protective plate, and disposed in sealed contact against said wall when the deflector is in the operational position;
- a retaining arm having one end fixed to the deflector toward said upper edge of said protective plate and another end removably linked with an element of said structure;
- wherein said retaining arm is an arm for pressing the protective plate so as to press the sealing gasket of the upper edge of the protective plate against the wall of the structure when the deflector is in the operational position;
- wherein the retaining arm, which is a pressing arm, of the plate is located below the plate and can be separated into -two parts, an upper part is fixed underneath the plate and a lower part to the support slab of the structure wall or, to the reinforcing sole of any accessory of this structure, ends of said parts facing each other being able to snap-fit together by pressing one against the other and moving one into the other during the positioning of the deflector and configured to stay linked together despite their setting into traction by reaction of the sealing gasket being compressed during the snap-fitting thereof;
- the deflector further comprising a support disposed toward a lower edge of the protective plate, separable into two parts to make the deflector removable, of which an upper part is fixed underneath the protective plate and a lower part is fixed to the slab or to a reinforcing sole of an accessory of the structure.

5. Deflector according to claim 1, wherein the deflector plate, when the latter is in the operational position, has a slope that allows for a flow of liquid without retention and a resistance to the vertical load of the liquid.

6. Deflector according to claim 1, further comprising a vertical edge along the lower edge of said sloping plate, when the deflector is in the operational position.

7. Deflector according to claim 1, wherein the adjustable support is able to be adjusted according to three axes in order to adjust the height of the sloping protective plate with respect to the slab, and retain on the one hand the latter bearing on the wall of the structure to be protected and on the other hand in a sloped position according to the desired angle.

8. Deflector assembly comprising a plurality of deflectors each according to claim 1, independent from one another and positioned one after the other in a continuous manner around and against the feet of the wall of the structure.

9. Deflector assembly according to claim 8, wherein each deflector comprises along one side edges thereof, covering elements that cover an empty space between adjacent deflectors.

* * * * *